United States Patent [19]

Stockdale

[11] 4,064,509

[45] Dec. 20, 1977

[54] INTRUSION DETECTION SYSTEMS EMPLOYING AUTOMATIC SENSITIVITY ADJUSTMENTS

[75] Inventor: Roy Stockdale, Huntington, N.Y.

[73] Assignee: Napco Security Systems, Inc., Copiague, N.Y.

[21] Appl. No.: 706,210

[22] Filed: July 19, 1976

[51] Int. Cl.[2] ..... G08B 13/18

[52] U.S. Cl. ..... 340/411; 340/258 B; 340/276

[58] Field of Search ..... 340/411, 276, 258 B; 250/214 AG, 221; 328/2, 5, 6; 330/86

[56] References Cited

U.S. PATENT DOCUMENTS

| | | | |
|---|---|---|---|
| 3,225,304 | 12/1965 | Richards | 250/214 AG |
| 3,652,791 | 3/1972 | Shuey | 250/214 AG |
| 3,859,647 | 1/1975 | Ross | 340/258 B |
| 3,879,719 | 4/1975 | Buckley et al. | 340/258 B |
| 3,995,221 | 11/1976 | MacDonald | 328/6 |

*Primary Examiner*—Donald J. Yusko
*Attorney, Agent, or Firm*—Arthur L. Plevy

[57] ABSTRACT

An automatic test circuit for a photo electric intrusion system incorporates an electronic attenuator which serves to reduce the sensitivity of the receiver when a light beam does not impinge on a photocell located at the receiver. As soon as the light beam appears on the photocell, the sensitivity of the receiver is increased to a normal operating value. In this manner, if the beam were misaligned to cause less light to impinge on the photocell, the receiver would indicate an alarm condition to thereby inform a user of the problem.

11 Claims, 2 Drawing Figures

INTRUSION DETECTION SYSTEMS EMPLOYING AUTOMATIC SENSITIVITY ADJUSTMENTS

BACKGROUND OF INVENTION

This invention relates to intrusion detection systems in general and more particularly to an automatic sensitivity adjustment for such a system.

A major problem in intrusion detection systems is due to incorrect adjustment or alignment of the equipment as will be explained. In many such systems, if the equipment is improperly adjusted or aligned, a false alarm will occur. This creates great inconvenience both to the user and the manufacturer.

The adjustment and alignment of any such system requires proper and careful installation. Hence, prior art relied upon the installer to determine that an adequate margin of sensitivity was maintained in the system during installation. If the systems do not operate with a given safety factor, a borderline condition could occur where the system would be placed either in alarm or normal condition due to changes in ambient. The ambient conditions can vary widely and can serve to effect the background noise and hence, must be accounted for before the detection system will denote a true alarm. For example, such ambient noise conditions may occur due to expansion and compression of structural members contained in the building and so on.

Typical of this type of problem is an intrusion system which employs a photoelectric beam. The photo electric beam must be aligned in such a manner that there is an adequate amount of light emanating from the transmitter and focused at the receiver. The amount of light must be in excess of the level for marginal operation. Otherwise, a false alarm will occur when the photo electric receiver sensitivity is changed by ambient conditions which encompass natural phenomenon. Such changes as indicated above, may also include ambient light level changes, temperature changes, component aging, structural changes and so on.

While the problem is prevalent in a photo electric beam intrusion system, similar problems occur in ultrasonic systems, microwave systems and so on. Accordingly, the problem can be characterized in that there must be an adequate margin between an alarm and a normal condition, which margin must consider and take into account the above noted ambient conditions.

While the prior art was cognizant of these problems, the margin of safety was determined primarily by the installer. In this manner, the installer was responsible in determining the ambient problems so that he could adjust the sensitivity of the system to assure that the system would operate to provide adequate protection. If the installer was wrong, one would either experience a high percentage of false alarms or the sensitivity of the system would be reduced to a point which would result in marginal protection of the area.

The problem is recognized in U.S. Pat. No. 3,838,408 entitled *ENVIRONMENTAL TEST SWITCH FOR INTRUDER DETECTION SYSTEMS* issued on Sept. 24, 1974 to L. McMaster and assigned to Detection Systems, Inc. In this system, a switch was provided for the installer to access. This switch was designated as an environmental test switch and when activated, served to increase the systems sensitivity by a desired factor. When this was done, the installer adjusted the gain of the receiver to a level just below that which produced an alarm. When the switch was turned off or inactivated, the sensitivity was set at a proper level for a given margin of safety. In any event, this system again required the installer to depress the switch and to make the necessary adjustments. Accordingly, changes in environmental conditions which would lead to false alarms would not necessarily be identified in the above noted system.

It is therefore an object of this invention to provide an automatic sensitivity adjustment for a receiver which therefore eliminates the necessity of installation adjustments.

BRIEF DESCRIPTION OF PREFERRED EMBODIMENT

A photo electric intrusion system of the type employing a transmitter capable of providing a beam of light for impingement on a photocell associated with a receiver, said receiver operative to provide an alarm condition when said beam of light is interrupted, the improvement therewith comprising means for reducing the sensitivity of said receiver when said beam is interrupted and for increasing the sensitivity of said receiver when said beam impinges upon said photocell to cause said receiver to operate with a given margin of safety determined by said reduction in sensitivity.

DETAILED DESCRIPTION OF FIGURES

Figure 1:
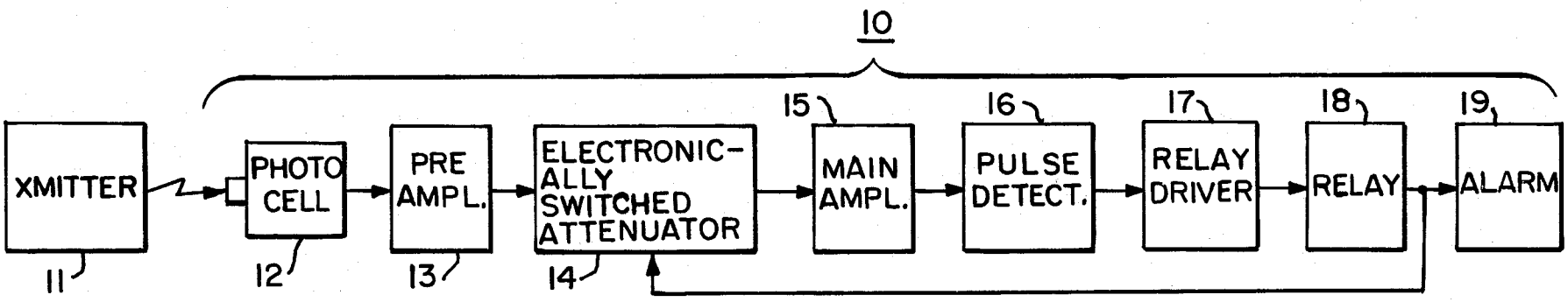
FIG. 1 is a block diagram of a photo electric detection system employing an automatic sensitivity adjustment according to this invention.

Referring to FIG. 1, there is shown a photo electric receiver 10 which contains components within a bracket. Basically, the photo electric receiver 10 requires a signal sensitivity such that a signal level may be reduced by a special amount which will still allow the receiver to function without giving an alarm. This sensitivity, based on ambient variations, may necessitate a fifty to seventy-five percent reduction in sensitivity during normal operation. This reduction in sensitivity is necessary to allow the receiver to operate under normal ambient conditions.

Briefly, the receiver operates in conjunction with a transmitter 11. The transmitter 11 which may be an infra-red light source, functions to provide a light beam across an area to be protected. This light beam may be pulse modulated or otherwise coded to prevent noise or spurious signals from activating the unit.

For the sake of simplicity and as is known, if an intruder breaks the beam, the receiver senses this condition and causes an alarm to be activated. The alarm may be in the form of a bell, a siren, or a visual indication such as a light and so on.

Accordingly, the receiver includes a photocell unit 12 upon which the light beam from the transmitter 11 impinges. The photocell has an output coupled to a preamplifier 13. The function of the amplifier 13 is to amplify the signal received from the photocell to assure adequate system operation.

The function of the photocell, as is well known, is to provide a first output signal when it is illuminated by said light beam and a second output signal for the absence of said light beam. Such photocells are well known in the state of the art and are fabricated from light sensing material, such as cadmium sulfide or materials which change or alter their impedance according to the light intensity.

In this invention, the output of the preamplifier is applied to the input of an electronic switched attenuator. Such attenuator circuits or switch gain control circuits are known in the art and many examples of suitable circuits can be had by referring to the prior art.

Essentially, the function of the electronically switched attenuator 14 is to control the signal of the receiver so that the overall gain or sensitivity of the receiver can be specified according to the setting or control of the attenuator 14. The output of the attenuator is coupled to a main amplifier circuit 15 where the signal is further amplified for application to a pulse detector 16.

The function of the pulse detector is also well known and basically, it responds to the pulse modulated light input to provide an output signal when the light beam is broken or interrupted by an intrusion. The output of the pulse detector 16 is applied to a relay driver circuit 17 which may be an ordinary amplifier. When the relay driver circuit operates above a threshold voltage, a relay 18 is activated which serves to energize an alarm circuit 19, which may be one of the various devices listed above.

The output of the relay driver circuit 17 is also fed back to an input of the electronically switched attenuator circuit 14. This output as will be described, controls the gain and therefore the sensitivity of the receiver. The circuit functions as follows:

If the photocell 12 does not have any light impinging upon it, it provides a signal at its output which basically is indicative of a beam interruption. This signal is amplified by the preamplifier 13 and is coupled to the main amplifier 15 via the attenuator 14. Under these conditions, the pulse detector provides an output signal which activates the relay driver 17. The relay driver 17 provides an output or a control voltage which is fed back to the electronic attenuator and serves to reduce the gain of the receiver by, for example, fifty to seventy-five percent. For example, as soon as the light beam is interrupted, the sensitivity of the receiver is reduced. When the light beam is restored, the sensitivity of the receiver is increased.

This therefore specifies that the receiver must have the required safety margin in order to allow it to reset after the light beam has been broken. After the beam has been restored and the receiver has started to function again, the signal reserve present will be adequate to allow for ambient changes.

For example, if there is no light impinging upon the photocell 12, the receiver will require fifty millivolts from the photocell to operate. Once it receives enough light to provide the fifty millivolts, the gain is switched via the attenuator so that a change of twenty-five millivolts can operate the alarm. This feature or this two-step level control operates as an automatic test feature in most installations during the day or during the time in which the alarm is turned off.

Normally in an area employing a photo electric intrusion system, the transmitter is operative during the day, but the alarm is deactivated. Hence, during this time, the beam is being constantly interrupted or broken because the occupants of the premises will be actuating the detection devices during this time and during the time the control unit is turned off. Hence, each time the light beam is interrupted, the sensitivity of the receiver is reduced by the predetermined factor which may be fifty to seventy-five percent of the normal operating gain. If the safety margin becomes inadequate, there will be an insufficient voltage developed at the output of the relay driver 17 to increase the gain of the receiver and as soon as the light beam is present at the input of the photocell 12, the receiver will not restore to normal operation and the alarm will be activated. This condition would be immediately determined by the user and hence, he would immediately know that the ambient level was too high and thus caused an alarm condition.

Hence, in this manner an alarm condition would be produced at a particular signal level at which point, the sensitivity of the receiver would be raised. If the noise level remained high, the detector would remain activated and hence, an alarm condition would appear when the unit was turned on at night, which would forewarn a user of the problem.

The reduction of sensitivity of the receiver by the attenuator in the range of fifty to seventy-five percent is adequate to cover and include typical variations provided by ambient conditions that one would experience in a normal operating environment. As soon as the sensitivity of the receiver is increased to normal and there is light impinging on the photocell, the sensitivity of the receiver is increased to a normal condition. However, as indicated if the amount of light has changed due to ambient levels or due to structural changes in the environment and so on, the signal will still not enable the receiver to restore to normal and the user will note that fact due to the permanent indication of an alarm condition.

As indicated above, since the unit is operating without the alarm during the day, the attenuator would constantly cause the sensitivity of the receiver to switch from the normal value to the attenuated value and if the ambient conditions were high enough, the detector would remain triggered until the ambient factors decreased below what would be considered to be a safe level. Hence, the user would immediately be forewarned of a problem and could take steps to prevent that problem before setting the unit into its intrusion mode. In this manner, one is assured that there is an adequate margin of safety against a false alarm by the factor of fifty to seventy-five percent. This safety margin is sufficient to prevent false alarms from occurring due to changes in ambient conditions as above indicated, while further assuring that the receiver is operating with good sensitivity during the intrusion mode.

The problem solved by the above noted system is particularly of concern in a photo electric system to assure that an optimum amount of light always impinges upon the photocell. Thus, in the above described system, if one inadvertently moved the transmitter and so on, one may not notice a problem during daytime operation due to the high ambient light and further due to the fact that the alarm would be turned off. However, under these conditions, the receiver will not restore and hence, this will be noticed immediately prior to night time use.

It is noted that all electrical circuits contained in the block diagram of the FIG. 1 of this application depict conventional components known to those skilled in the art.

Thus, there are many examples of electronically controlled attenuators which can reduce the gain of a signal by any preselected factor to thus afford a gain reduction of fifty to seventy-five percent on one mode and no reduction in gain in an alternate mode. The utility to photo electric systems is particularly apparent in that such systems do not normally employ gain controllable amplifiers and hence, the user or the installer has no simple means to adjust the gain of the preamplifier or of the amplifiers to attempt to set the systems at optimum values in conjunction with the use of a test switch or similar device.

Figure 2:
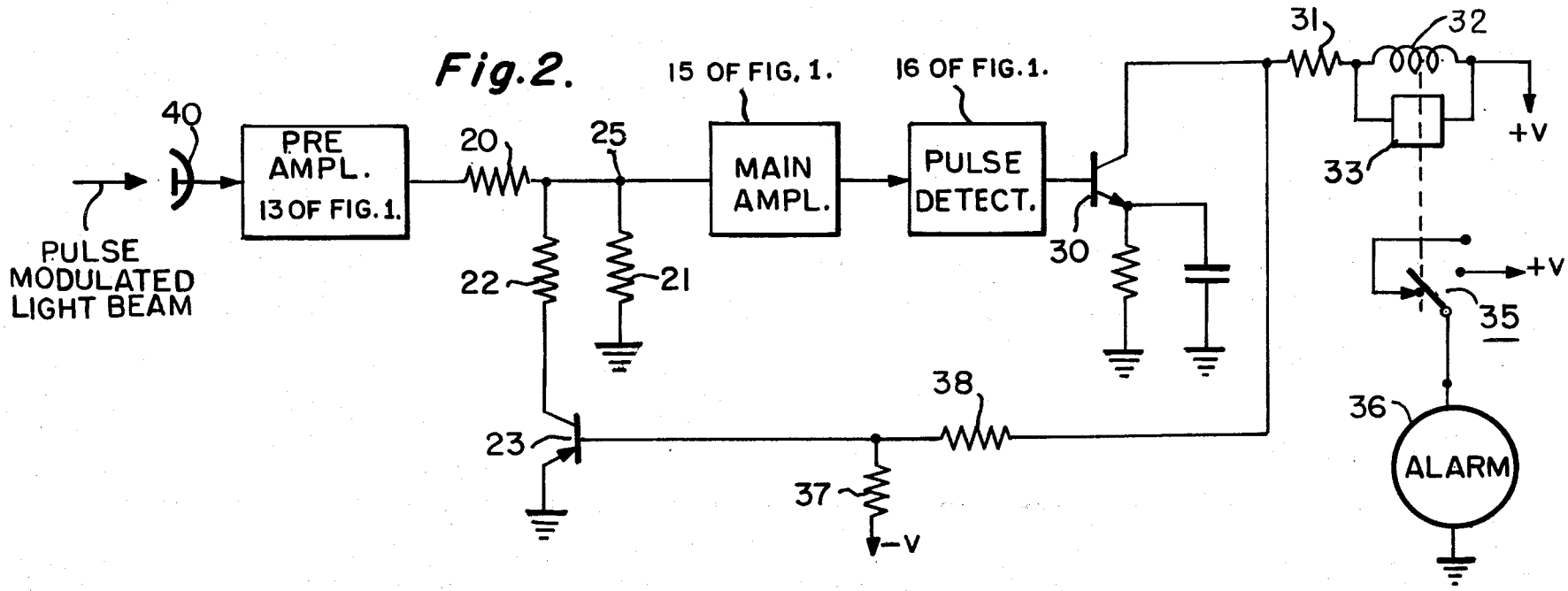
FIG. 2 is a partial schematic and block diagram depicting a sensitivity adjustment circuit.

Referring to FIG. 2, there is shown a simple circuit by way of example of how the attenuator would operate as indicated above. The preamplifier, which is an ordinary amplifier circuit known in the art, has its output coupled to the input of a controllable attenuator consisting of resistor 20 and resistor 21.

Resistor 21 is shunted by means of a resistor 22 in series with the collector to emitter path of a transistor 23. The output terminal 25 of the attenuator is coupled to the input of the main amplifier as 15 of FIG. 1. As indicated, the output of the pulse detector is coupled to the base electrode of a relay driver transistor 30. The collector electrode of transistor 30 has a series load consisting of a resistor 31 in series with a relay coil 32 to a source of operating potential. The relay coil 32 may be shunted by a transient suppressant network 33 which may be back to back diodes and so on.

The relay coil 32 is associated with a contact arrangement 35 which serves to activate an alarm circuit 36 upon activation of the relay.

The collector electrode of the relay driver 30 is returned to the base electrode of transistor 23 through a biasing network consisting of resistors 36 and 37. In this manner, if there is no light beam appearing on the photocell 40 associated with the preamplifier, the relay driver circuit 30 forward biases transistor 23 and hence, the signal level at the main amplifier is reduced due to the shunting of resistors 22 and 21. As soon as a light beam is available at the photocell 40, transistor 30 reverse biases transistor 23. Thus, the signal available at the main amplifier is increased due to the fact that resistor 22 is effectively removed from the circuit.

Hence, the sensitivity of the receiver is reduced when there is no light beam impinging on the photocell and is increased when the light beam appears. Thus, the photo electric receiver must have the required safety margin in order to reset after the beam has been broken to thereby provide the above noted advantages. The selection of values of the resistors 20, 21 and 22 determines the amount of attenuation available during operation and hence, determines the reduction and sensitivity of the receiver.

While the above described apparatus relates to a photo electric intrusion system, the concept and apparatus for reducing the sensitivity during the absence of signal or for a weak signal condition and increasing the sensitivity for high signal conditions, has applicability in microwave or ultrasonic intrusion systems as well as in other systems employing a received and transmitted signals. Such applications should be apparent to those skilled in the art.

I claim:

1. In a photo electric intrusion system of the type employing a transmitter capable of providing a beam of light for impingement on a photocell associated with a receiver, said receiver capable of providing an alarm condition when said light beam is interrupted during an intrusion operating mode, the improvement therewith of apparatus for reducing the sensitivity of said receiver when said light beam is not impinging upon said photocell, comprising:

a. attenuator means coupled to said photocell and capable of being switched in a first mode to provide a given attenuation to said photocell signal and a second mode for providing a lesser attenuation to said signal, b. means coupled to said attenuator for switching the same into said first mode during the interruption of said light beam and into said second mode when said light beam impinges upon said photocell, whereby the sensitivity of said receiver is reduced during said first mode and increased during said second mode.

2. In a system of the type employing a transmitter capable of providing a beam of energy for reception by receiving means, said receiving means responsive to said beam to provide an indication, the improvement therewith of apparatus for reducing the sensitivity of said receiver when said beam is interrupted, comprising:

a. attenuator means coupled to said receiver and capable of being switched in a first mode to provide a given attenuation to said transmitted signal as received and a second mode for providing a lesser attenuation to said signal as received, b. means coupled to said attenuator for switching the same into said first mode during the interruption of said beam and into said second mode when said beam is received, whereby the sensitivity of said receiver is reduced during said first mode and increased during said second mode.

3. A photo electric receiver of the type responsive to a transmitted beam of light for providing an alarm signal upon interruption of said beam comprising in combination:

a. a photocell responsive to said beam for providing a first output signal upon illumination of said photocell by said beam, and a second signal for the absence of said beam, b. an electronic attenuator coupled to said photocell and operative to provide a first attenuation in a first mode and a second greater attenuation in a second mode, c. an amplifier coupled to said attenuator for providing an output related to the signal input applied thereto from said attenuator, and d. means for feeding back a signal from said amplifier to said attenuator for operating the same in said first mode for the presence of said first output signal from said photocell and in said second mode for the presence of said second signal from said photocell to cause said receiver to operate at an increased sensitivity for said first output signal and at a reduced sensitivity for said second signal.

4. The photo electric receiver according to claim 3 wherein said first attenuation of said attenuator is fifty to seventy-five percent less than said second attenuation.

5. The photo electric receiver according to claim 3 wherein said amplifier has an output coupled to a relay coil for energizing said coil when said photocell provides said second signal for a given duration.

6. The photo electric receiver according to claim 3 wherein said photocell is responsive to infra-red light.

7. The photo electric receiver according to claim 3 further including a pre-amplifier circuit coupled between said photocell and said attenuator to provide an additional gain to said photocell signals.

8. The photo electric receiver according to claim 5 wherein said relay coil is further associated with a switchable contact to provide an alarm condition when said coil is energized.

9. In a photo electric intrusion system of the type employing a transmitter capable of providing a beam of light for impingement on a photocell associated with a receiver, said receiver operative to provide an alarm condition when said beam of light is interrupted, the improvement therewith comprising means for reducing the sensitivity of said receiver when said beam is interrupted and for increasing the sensitivity of said receiver when said beam impinges upon said photocell, to cause said receiver to operate with a given margin of safety determined by said reduction in sensitivity.

10. The photo electric intrusion system according to claim 9 wherein said transmitter is capable of providing an infra-red beam of light.

11. In a system of the type employing a signal to be received by a receiving unit, the improvement therewith of apparatus for reducing the sensitivity of said receiving unit when said signal is not being received, comprising:

a. attenuator means coupled to said receiving means and capable of being switched in a first mode to provide a given attenuation to said signal as received and a second mode for providing a lesser attenuation to said signal as received, b. means coupled to said attenuator for switching the same into said first mode when said signal is not received and into said second mode when said signal is received, whereby the sensitivity of said receiver is reduced during said first mode and increased during said second mode.

* * * * *